US010330340B2

(12) United States Patent
Yuan et al.

(10) Patent No.: US 10,330,340 B2
(45) Date of Patent: Jun. 25, 2019

(54) ALTERNATIVE COIL FOR FIRED PROCESS HEATER

(71) Applicant: UOP LLC, Des Plaines, IL (US)

(72) Inventors: Quan Yuan, Buffalo Grove, IL (US); Rajeswar Gattupalli, Buffalo Grove, IL (US); Ka Lok, Buffalo Grove, IL (US); William M. Hartman, Des Plaines, IL (US); Bryan J. Egolf, Crystal Lake, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 15/798,355

(22) Filed: Oct. 30, 2017

(65) Prior Publication Data

US 2018/0051906 A1 Feb. 22, 2018

Related U.S. Application Data

(63) Continuation of application No. PCT/US2016/038543, filed on Jun. 21, 2016.

(60) Provisional application No. 62/186,536, filed on Jun. 30, 2015.

(51) Int. Cl.

| | |
|---|---|
| ***F24H 1/40*** | (2006.01) |
| ***F28D 7/16*** | (2006.01) |
| ***F24H 1/16*** | (2006.01) |
| ***F23C 3/00*** | (2006.01) |
| ***F23C 5/28*** | (2006.01) |

(52) U.S. Cl.

CPC ..... *F24H 1/165* (2013.01); *F23C 3/00* (2013.01); *F23C 5/28* (2013.01)

(58) Field of Classification Search

CPC ..... F24H 1/40; F28D 7/16; F28D 7/1623

See application file for complete search history.

(56) References Cited

U.S. PATENT DOCUMENTS

| | | | | |
|---|---|---|---|---|
| 2,338,295 A * | 1/1944 | Mekler | C10G 9/20 | 122/240.1 |
| 3,127,876 A * | 4/1964 | Olson | C21B 9/10 | 122/276 |
| 3,182,638 A * | 5/1965 | Lee | C10G 9/20 | 122/240.1 |
| 3,237,610 A * | 3/1966 | Von Wiesenthal | C10G 9/20 | 122/240.1 |
| 3,512,506 A * | 5/1970 | Von Wiesenthal | C10G 9/20 | 122/356 |
| 3,667,429 A * | 6/1972 | Cross | B01J 8/062 | 122/240.3 |

(Continued)

FOREIGN PATENT DOCUMENTS

| | | |
|---|---|---|
| RU | 2052733 C1 | 1/1996 |
| RU | 2256127 C1 | 7/2005 |

OTHER PUBLICATIONS

Search Report dated Oct. 20, 2016 for corresponding PCT Appl. No. PCT/US2016/038543.

*Primary Examiner* — Gregory A Wilson

(57) ABSTRACT

An apparatus for a fired heater is presented. The fired heater is designed with a plurality of process coils inside a shell, and with a positioning of the burners for reducing the size of the fired heater. The shell has a general rectangular prismatic shape with combustion inlets for admitting combustion gases from the burners, and the process coils include at least two inlet ports and at least one outlet port.

22 Claims, 3 Drawing Sheets

(56) References Cited

U.S. PATENT DOCUMENTS

| | | | | | |
|---|---|---|---|---|---|
| 4,166,434 | A * | 9/1979 | Jensen | C10G 9/20 | 122/275 |
| 4,494,485 | A * | 1/1985 | Kendall | C10G 9/20 | 122/250 R |
| 5,365,887 | A * | 11/1994 | Fenn | F24H 1/145 | 122/155.2 |
| 7,395,785 | B1 * | 7/2008 | Cross | C10G 9/20 | 122/174 |
| 7,740,751 | B2 * | 6/2010 | Peters | C10G 59/02 | 208/133 |
| 8,282,814 | B2 * | 10/2012 | Peters | C10G 9/00 | 122/37 |
| 2012/0227681 | A1 | 9/2012 | Min | | |

* cited by examiner

ALTERNATIVE COIL FOR FIRED PROCESS HEATER

CROSS-REFERENCE TO RELATED APPLICATIONS

This application is a Continuation of copending International Application No. PCT/US2016/038543 filed Jun. 21, 2016 which application claims benefit of U.S. Provisional Application No. 62/186,536 filed Jun. 30, 2015, the contents of which cited applications are hereby incorporated by reference in their entirety.

FIELD OF THE INVENTION

The present invention relates to fired heaters for use in chemical processes.

BACKGROUND

Fired heaters are common process units in chemical plants. The fired heaters heat process streams to reaction temperatures, and provide heat to process streams that have endothermic reactions. A fired heater has a general configuration of a tube for carrying a process fluid inside a shell wherein burners are used to combust a fuel to heat the tubes.

With more complex processes, and with upgrades to processes in chemical plants, new configurations are needed to reduce the area taken up by fired heaters, and to provide for new efficiencies in the heating of process fluids.

SUMMARY

The present invention is a new apparatus for a fired burner to heat a process stream. A first embodiment of the invention is an apparatus for heating a process fluid, comprising a shell having sides, an upper surface, a lower surface, combustion fluid inlets and a flue gas outlet, wherein the combustion fluid inlets are for admitting a combustion mixture; at least one process coil comprising at least two inlet ports, at least two U-shaped process tubes with the end of each tube merging to form one outlet port, and disposed within the shell; and at least two burners disposed on the sides of the shell, and in an opposing configuration. An embodiment of the invention is one, any or all of prior embodiments in this paragraph up through the first embodiment in this paragraph wherein the process coil inlet ports and the outlet port are disposed on the lower surface of the shell. An embodiment of the invention is one, any or all of prior embodiments in this paragraph up through the first embodiment in this paragraph wherein the process coil inlet ports and the outlet port are disposed on the upper surface of the shell. An embodiment of the invention is one, any or all of prior embodiments in this paragraph up through the first embodiment in this paragraph wherein the flue gas outlet is disposed on the upper surface of the shell. An embodiment of the invention is one, any or all of prior embodiments in this paragraph up through the first embodiment in this paragraph wherein the flue gas outlet is disposed on the lower surface of the shell. An embodiment of the invention is one, any or all of prior embodiments in this paragraph up through the first embodiment in this paragraph wherein the process coil has a configuration of four tubes in a parallel orientation, with two semi-circular tubular sections connecting the ends of pairs of the tubes, such that the tubes form a coil having two U-shaped sections, with each U-shaped section having an outer tube closer to the sides of the shell and an inner tube closer to the centerline of the shell. An embodiment of the invention is one, any or all of prior embodiments in this paragraph up through the first embodiment in this paragraph wherein the shell has a substantially rectangular prismatic shape, with a height, a depth and a width, and wherein the process coils extend at least 70% of the height, and the process coils are arranged across the width with the two tubes arrayed substantially along an axis that is in the middle of the width of the shell, and wherein the outer tubes are arrayed in a position between 5% and 95% of the distance of the half-width of the shell. An embodiment of the invention is one, any or all of prior embodiments in this paragraph up through the first embodiment in this paragraph wherein tubes have substantially the same diameter. An embodiment of the invention is one, any or all of prior embodiments in this paragraph up through the first embodiment in this paragraph wherein the shell has a substantially rectangular prismatic shape, with a height, a depth and a width, and wherein the burners are disposed on opposite sides of the width of the shell, and wherein the burners are disposed within 10% of the height from the bottom of the shell. (in spec. define width and height as providing a cross-sectional view, with the depth providing for multiple tubes. An embodiment of the invention is one, any or all of prior embodiments in this paragraph up through the first embodiment in this paragraph wherein the apparatus further includes at least a second pair of burners disposed on opposite sides of the width of the shell and at a height between 30% and 80% of the height from the bottom of the shell. An embodiment of the invention is one, any or all of prior embodiments in this paragraph up through the first embodiment in this paragraph further comprising a first manifold having an inlet and multiple outlets, wherein each outlet is in fluid communication with the first inlet port of the process coil; a second manifold having an inlet and multiple outlets, wherein each outlet is in fluid communication with the second inlet port of the process coil; and a third manifold having multiple inlets and an outlet, wherein each inlet is in fluid communication with the outlet of the process coil. An embodiment of the invention is one, any or all of prior embodiments in this paragraph up through the first embodiment in this paragraph wherein the shell has a substantially rectangular prismatic shape, with a height, a depth and a width, and wherein there are up to 120 coils and at least one pair of burners for every 6 to 10 coils. An embodiment of the invention is one, any or all of prior embodiments in this paragraph up through the first embodiment in this paragraph wherein the shell has a substantially rectangular prismatic shape, with a height, a depth and a width, and wherein there are up to 120 coils and at least two pairs of burners for every 12 to 20 coils. An embodiment of the invention is one, any or all of prior embodiments in this paragraph up through the first embodiment in this paragraph wherein the shell has a substantially rectangular prismatic shape, with a height between 8 m and 25 m, a depth 0.1 m to 0.5 m/coil, and a width between 6 m and 20 m.

A second embodiment of the invention is an apparatus for heating a process fluid, comprising a shell having sides, an upper surface, a lower surface, combustion fluid inlets and a flue gas outlet, and wherein the shell has a substantially rectangular prismatic shape, with a height, a depth and a width; a plurality of process coils, each process coil comprising two inlet ports, a first inlet port and a second inlet port, two U-shaped process tubes with the end of each tube merging to form one outlet port, and disposed within the shell; and at least two burners disposed on the sides of the shell, and in an opposing configuration. An embodiment of the invention is one, any or all of prior embodiments in this paragraph up through the second embodiment in this paragraph wherein the coils have the inlet ports and outlet port on the upper surface, and the flue gas outlet is centered on the lower surface. An embodiment of the invention is one, any or all of prior embodiments in this paragraph up through the second embodiment in this paragraph wherein the coils have the inlet ports and outlet port on the lower surface and the flue gas outlet on the upper surface. An embodiment of the invention is one, any or all of prior embodiments in this paragraph up through the second embodiment in this paragraph further comprising a first manifold having an inlet and multiple outlets, wherein each outlet is in fluid communication with the first inlet port of the process coil; a second manifold having an inlet and multiple outlets, wherein each outlet is in fluid communication with the second inlet port of the process coil; and a third manifold having multiple inlets and an outlet, wherein each inlet is in fluid communication with the outlet of the process coil. An embodiment of the invention is one, any or all of prior embodiments in this paragraph up through the second embodiment in this paragraph wherein the burners are disposed on opposite sides of the width of the shell, and wherein the burners are disposed less than 10% of the height from the bottom of the shell. An embodiment of the invention is one, any or all of prior embodiments in this paragraph up through the second embodiment in this paragraph wherein the apparatus further includes at least a second pair of burners disposed on opposite sides of the width of the shell and at a height between 30% and 80% of the height from the bottom of the shell.

Other objects, advantages and applications of the present invention will become apparent to those skilled in the art from the following detailed description and drawings.

DETAILED DESCRIPTION

Figure 1:
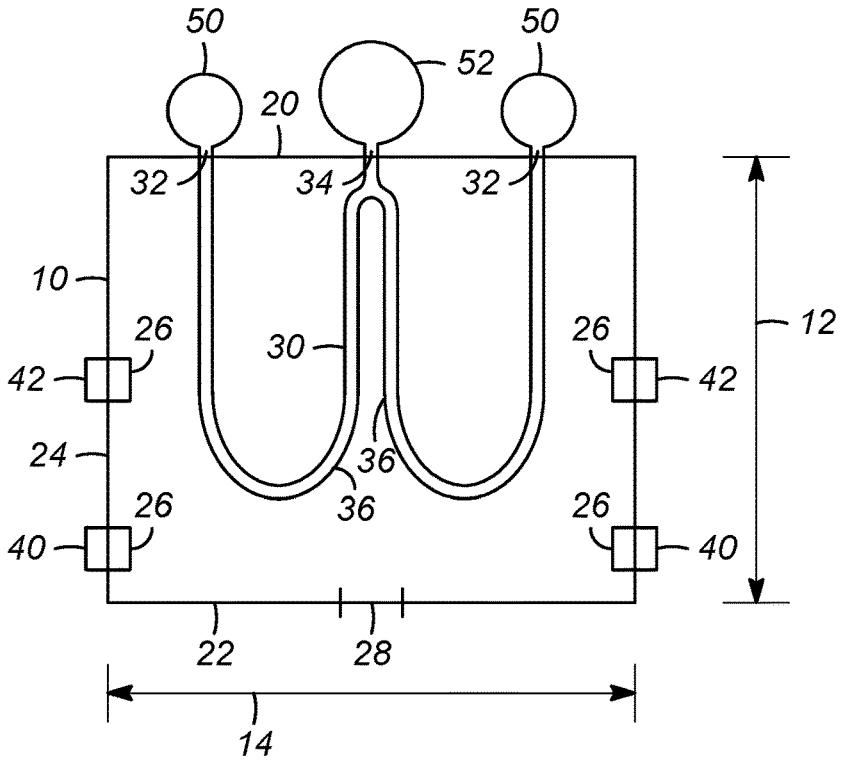
FIG. 1 shows a single coil arranged within the apparatus, across the width of the shell.

Chemical processes frequently need heating. Process heaters are designed to heat feed streams or intermediate process streams to temperatures necessary for the chemical reactions in the processes to occur at a reasonable rate. Dual-cell fired process heaters are equipped with "U-shaped" coils that allow for a process fluid to be heated. The coils are mounted in fired heaters that include burners. A fired heater is typically a box-shaped furnace with the coils inside the box and burners mounted on the sides or bottoms of the furnace. For a commercial process, a fired heater can be a very large item. Fired heaters are a major component for equipment cost in a reforming unit, or a dehydrogenation unit. The fired heaters can be as much as 25% of the equipment cost, and improvements in the designs to reduce costs are important. A process coil, as used in the present description comprises two tubular sections with each section having a generalized U-shape configuration. The process coil has two parts with the tow inlets toward the side walls and one or two outlets toward the center of the shell.

Fired process heaters often cause non-selective reactions, such as thermal conversion or cracking of hydrocarbons. These non-selective reactions reduce yields and increase losses. Redesigned heaters can reduce these losses and proved for more desirable capital cost, operation costs and reduced area, or smaller plot space, required for a heater.

The present invention provides a new heater configuration that includes a change in the coil geometry and burner positioning. The present invention is an apparatus for a fired heater to heat a process fluid. The apparatus includes a shell having a generalized rectangular prismatic shape with an upper surface, a lower surface, and sides. The shell includes inlets for admitting a combustion fluid, and a flue gas outlet. The flue gas outlet can be disposed on the upper surface or the lower surface of the shell. The flue gas outlet can also be positioned in one or more of the sides and within 10% of the height of the top of the sides. The apparatus further includes at least one process coil disposed within the shell and comprising at least two inlet ports, at least two U-shaped process tubes and with one end of each U-shaped process tube merging to form one outlet port. The apparatus further includes at least two burners disposed on the sides of the shell and in an opposing configuration. The burners can be in a symmetrical opposing configuration, or in a staggered opposing configuration.

In one embodiment, the process coil inlet ports and the outlet ports are disposed on the upper surface of the shell. The process coil has a configuration of at least two U-shaped tubes in a parallel orientation, with the inlet sections disposed between 5% and 95% of the distance between the side of the shell and the center of the shell, and with outlet sections of the tubes disposed toward the center of the shell.

In another embodiment, the process coil inlet ports and the outlet ports are disposed on the lower surface of the shell. The process coil has a configuration of at least two U-shaped tubes in a parallel orientation, with the inlet sections disposed between 5% and 95% of the distance between the side of the shell and the center of the shell, and with outlet sections of the tubes disposed toward the center of the shell.

The apparatus comprises a plurality of process coils spaced to allow flow of the hot combustion flue gases. Each process coil has a configuration of four tubes in a parallel orientation with two curved tubular sections connecting a pair of the tubes. The curved tubular sections can have a semi-circular shape. The combination of the tubes and tubular sections create a coil having two U-shaped sections, with each U-shaped section having an outer tube closer to the sides of the shell and an inner tube closer to the centerline of the shell. The inlet ports to the coil are in fluid communication with the outer tubes, and the inner tubes are connected to merge and be in fluid communication with the outlet port. The tubes and tubular sections has substantially the same diameter. In one embodiment, the inlet section is at least one pipe size smaller or at least one pipe size larger than the outlet section.

The shell has a height, a depth and a width, wherein the coils are oriented in a planar section across the height and width of the shell. The depth of the shell is substantially determined by the number of coils within the shell, and wherein there can comprise up to 120 coils within the shell. The process coils extend to at least 70% of the height of the shell, and the coils are oriented such that each of the U-shaped sections span from the side of the shell to the half-width of the shell, and wherein the outer tubes are arrayed in a position between 5% and 95% of the distance of the half-width of the shell. For purposes of the description, the width is the direction across the shell and is the direction with the orientation of the coils across the shell, and the depth is the direction perpendicular to the width and the direction along which an array of coils are disposed.

The apparatus includes burners that generate a hot gas, and radiant energy, for heating the process fluid in the coils. The burners are disposed in the sides of the shell, and pairs of burners are disposed on opposite sides of the width of the shell. A first pair of burners are disposed within 10% of the height of the shell from the bottom of the shell. There are up to 120 coil in the apparatus, and there is a first pair of burners disposed within the shell sides for every 6 to 10 coils, or from 12 to 20 first pair of burners for a fired heater with 120 coils.

The apparatus can include a second pair of burners on opposite sides of the width of the shell and at a height between 30% and 80% of the height of the shell from the bottom of the shell. For the apparatus with the second pair of burners, or two pairs of burners, there are two pairs of burners for every 12 to 20 coils, or for a 120 coil apparatus, there are from 24 to 40 pairs of burners with half of the burners as first pairs, and half as second pairs.

The apparatus can further include several manifolds for the transport of the process stream into and out of the fired heater. The apparatus includes two inlet manifolds, a first and second manifold, wherein each inlet manifold has an inlet for admitting the process stream, and multiple outlets, wherein each outlet is in fluid communication with a process coil inlet, with each process coil having each inlet port in fluid communication with a separate manifold. The apparatus includes at least one outlet manifold, third manifold, having multiple inlets and at least one outlet, wherein each inlet is in fluid communication with the outlet port of a separate process coil.

The apparatus is for large scale heating of process fluids, and will have a height between 8 m and 25 m, a width between 6 m and 20 m, and a depth between 0.1 m/coil and 0.5 m/coil. The apparatus can contain up to 120 process coils. For an apparatus with 120 process coils, the depth will be between 12 m and 60 m.

FIG. 1 shows a single coil arrayed across the width of the shell. The apparatus shows the shell 10 having a height 12 and a width 14. The shell includes an upper surface 20, a lower surface 22, sides 24, combustion fluid inlets 26 and a flue gas outlet 28. The apparatus includes at least one process coil 30 disposed within the shell, and which includes at least two inlet ports 32 and one outlet port 34. The process coil 30 comprises two U-shaped process tubes 36, where the outlet ends of each process tube 36 merge to form the outlet port 34. The apparatus includes a first set of at least two burners 40 disposed on the sides of the shell in an opposing configuration. The inlet ports 32 are in fluid communication with inlet manifolds 50, and the outlet port 34 is in fluid communication with the outlet manifold 52. In an alternative arrangement, the burners can be disposed on the sides at the ends of the depth of the apparatus in an opposing configuration.

The apparatus can include a second set of burners 42 arrayed at an elevated position relative to the first set of burners 40. The second set of burners 42 is also disposed on the sides in an opposing configuration, but can also be offset relative to the first set of burners along the depth of the shell 10.

Figure 2:
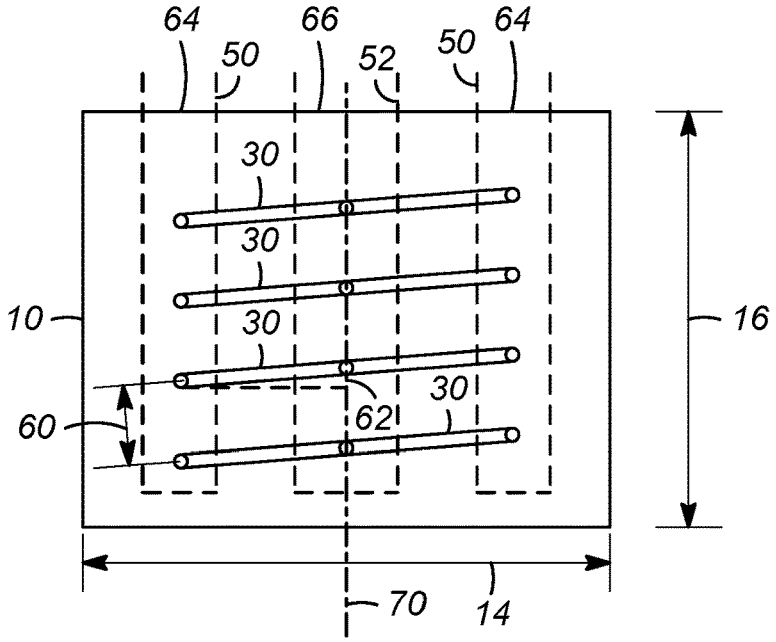
FIG. 2 shows a view of an array of several coils, from below, wherein the array is along the depth of the shell, and the inlet sections and outlet sections can be staggered relative to each other.
Figure 3:
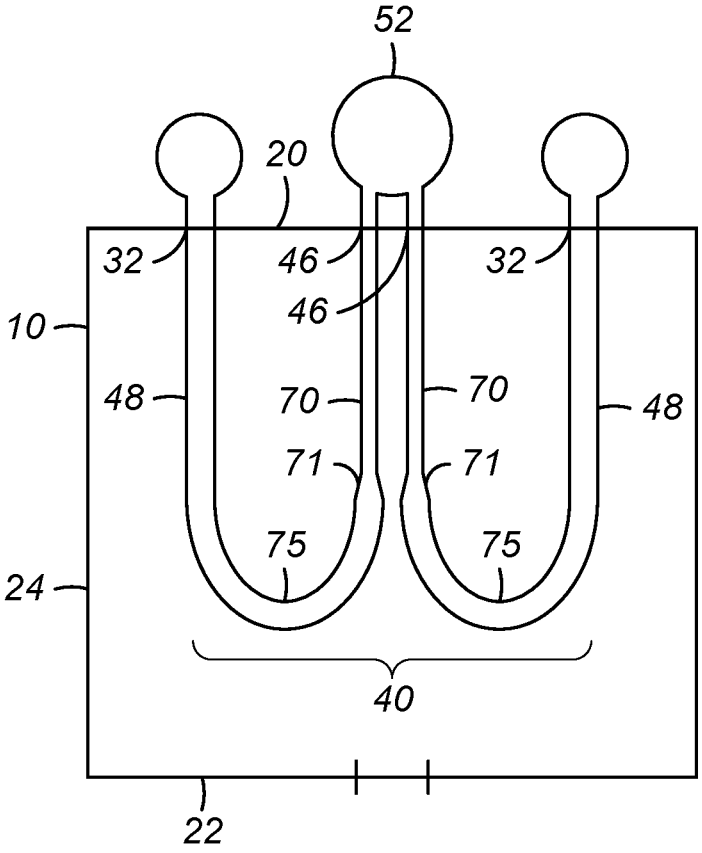
FIG. 3 shows an embodiment of the process coils having reducers in the coils.

FIG. 2 displays a view of the apparatus from underneath and shows the orientation of the coils across the width of the shell and an array of coils disposed along the depth of the shell. The apparatus has a shell 10 having a width 14 and a depth 16. Each coil 30 is arrayed across the width 14 and spaced apart from a neighboring coil by a distance 60 apart. The distance, or spacing 60 is between 0.1 m and 0.5 m from center of a coil to the center of a neighboring coil. The coils can be angled across the width 14. The angled positioning is such that the spacing 62 of the center of the coil 30 from a line passing across the width 14 and through one end of the coil is between 0 and 0.5 times the spacing 60 between neighboring coils 30. The outlets 34 of each coil 30 lies substantially along a central axis 70 that runs along the depth of the apparatus. The inlet sections of the coils 30 lie in a line along a lane 64, and the outlet sections of the coils 30 lien in a line along a lane 66. The inlet sections and outlet sections can be arranged in a line substantially parallel to an end wall, or can be in a staggered configuration. FIG. 3 shows a staggered configuration wherein the two lanes 64 of the inlet sections are staggered relative to the lane 66 of the outlet section.

The apparatus can include the flue gas outlet in either the lower surface of the shell, or the flue gas outlet can be in the upper section of the sides of the shell. While a preferred orientation for the coils is to have the coils hanging from the upper surface with the coil inlets and outlet in the upper surface, an alternate embodiment has the coils affixed to the lower surface and with the coil inlets and outlet in the lower surface.

In one embodiment, the apparatus comprises a shell having an upper surface, a lower surface, combustion fluid inlets and a flue gas outlet. The apparatus includes at least one process coil, wherein each process coil comprises two U-shaped tubular sections, with each section having a process fluid inlet, and a process fluid outlet. A cross-section of the fired heater is shown in FIG. 3. The shell 10 has sides 24, an upper surface 20 and a lower surface. The process coil 40 comprises two U-shaped sections 75. Each U-shaped section 75 has an inlet 32 and an outlet 46, admitting a process fluid to in outer section 48, and wherein the process fluid flows through the outer section 48 to an inner section 70. The U-shaped tubes are oriented to have the inner section 70 toward the midpoint between the sides, or substantially near the centerline of the shell, and the outer sections 48 are between the inner sections 70 and the shell sides 24. In one variation the inner section 70 has a narrower tube diameter than the outer section 48 of the U-shaped tubular sections. The inner section 70 includes a tube reducer 71. The inner section 70 is the outlet portion of the U-shaped tubular section, and the outer section 48 is the inlet portion of the U-shaped tubular section.

Figure 4:
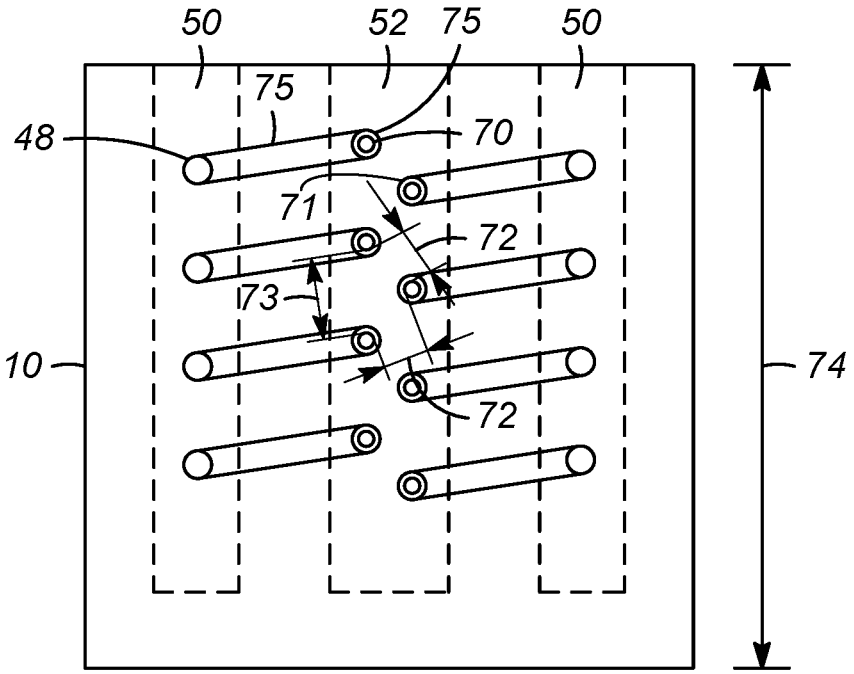
FIG. 4 shows an embodiment of the process coils with reducers in a staggered orientation.

In a preferred embodiment, the inner section 70 has a diameter between 70% and 90% of the outer section 48 diameter. The tubular sections can be made from standard sized tubes, and in one variation the inner section has a tube size that is one standard size smaller than the outer section tube size. As seen in FIG. 4, the outlet sections 70 are staggered from each other communicating to outlet manifold 52 outside the shell. The skin to skin spacing 73 between two adjacent outlets of U-tubes 75 originated from same inlet manifold is between 38 mm to 150 mm. The skin to skin spacing 72 between two adjacent outlets 70 of U-tubes originated from each of the two inlet manifolds is no less than 38 mm. The staggered outlet 70 configuration and smaller diameter outlet 70 reduces the manifold length and heater depth 74. The outlets 70 from the process coils are preferably aligned for facilitating the manufacture of the fired heater and the outlet manifold. The process coil outlets 70 upon leaving the fired heater can be shaped to form a line along the outlet manifold. In an alternative, the process coil outlets can be curved to have the process fluid flow initially in the radial direction into outlet manifold, or can be affixed for flowing at another angle to entry into the outlet manifold.

A comparison of the process coil having no reducer section and no staggering coils to outlet manifold attachment, the inventory reduces the manifold length, with a process coil having a reduced inner section was performed. The standard tube size was a 5-inch tube, with a reduction to a 4-inch tube. The reduction in the size for the inner section reduces the maximum peak film temperature on the surface of the inner section, or outlet section, of the process coil.

The arrangement of the process coils can influence the size, and in particular the width of the fired heater shell. In order for there to be efficient flow of the combustion gases around the process coils, the spacing between the process coils needs to be at least 1.6 times the tube diameters. In one embodiment, the process coils can be arrayed in a staggered arrangement. Neighboring process coils can be displaced, horizontally, in a direction transverse to the alignment of the process coils relative to each other. If the process coils form a general line along the depth of the fired heater shell, the displacement will be in the perpendicular direction, or along the width. In a variation on this embodiment, the process coils can be disposed at an angle relative to the width, as described above, and additionally in a staggered orientation relative to the neighboring process coils. The staggering distance can be large, but a preferred staggering distance is less than three times the diameter of a process coil. In addition, the angling of the process coils, when staggered, allows for a closer alignment of the inlet and outlet ports along the lanes 64, 66 for the line of inlet and outlet ports.

While the invention has been described with what are presently considered the preferred embodiments, it is to be understood that the invention is not limited to the disclosed embodiments, but it is intended to cover various modifications and equivalent arrangements included within the scope of the appended claims.

What is claimed is:

1. An apparatus for heating a process fluid, comprising:

a shell having sides, an upper surface, a lower surface, combustion fluid inlets and a flue gas outlet, wherein the combustion fluid inlets are for admitting a combustion mixture;

at least one process coil comprising at least two inlet ports, at least two U-shaped process tubes with the end of each tube in fluid communication with at least one outlet port, and disposed within the shell;

at least two burners disposed within the shell and on opposite sides of the shell;

a first manifold having an inlet and multiple outlets, wherein each outlet is in fluid communication with the first inlet port of the process coil;

a second manifold having an inlet and multiple outlets, wherein each outlet is in fluid communication with the second inlet port of the process coil; and a third manifold having multiple inlets and an outlet, wherein each inlet is in fluid communication with the outlet of the process coil.

2. The apparatus of claim 1 wherein the process coil inlet ports and the outlet port are disposed on the upper surface of the shell.

3. The apparatus of claim 1 wherein the flue gas outlet is disposed on the lower surface of the shell.

4. The apparatus of claim 1, wherein the inlet section and outlet section of the process coils are arranged inline, or in a staggered configuration, and the two lanes of the inlet section are staggered with respect to the two lanes of the outlet section.

5. The apparatus of claim 1 wherein the process coil has a configuration of four tubes in a parallel orientation, with two semi-circular tubular sections connecting the ends of pairs of the tubes, such that the tubes form a coil having two U-shaped sections, with each U-shaped section having an outer tube closer to the sides of the shell and an inner tube closer to the centerline of the shell.

6. The apparatus of claim 5 wherein the shell has a substantially rectangular prismatic shape, with a height, a depth and a width, and wherein the process coils extend at least 70% of the height, and the process coils are arranged across the width with the two tubes arrayed substantially along an axis that is in the middle of the width of the shell, and wherein the outer tubes are arrayed in a position between 5% and 95% of the distance of the half-width of the shell.

7. The apparatus of claim 5 wherein tubes have substantially the same diameter.

8. The apparatus of claim 1 wherein the shell has a substantially rectangular prismatic shape, with a height, a depth and a width, and wherein the burners are disposed on opposite sides of the width of the shell, and wherein the burners are disposed within 10% of the height of the shell and from the bottom of the shell, or the burners can be on the lower surface of the shell.

9. The apparatus of claim 8 wherein the apparatus further includes at least a second pair of burners disposed on opposite sides of the width of the shell and at a height between 30% and 80% of the height from the bottom of the shell.

10. The apparatus of claim 1 wherein the shell has a substantially rectangular prismatic shape, with a height, a depth and a width, and wherein there are up to 120 coils and at least one pair of burners for every 6 to 10 coils.

11. The apparatus of claim 1 wherein the shell has a substantially rectangular prismatic shape, with a height, a depth and a width, and wherein there are up to 120 coils and at least two pairs of burners for every 12 to 20 coils.

12. The apparatus of claim 1 wherein the shell has a substantially rectangular prismatic shape, with a height between 8 m and 25 m, a depth 0.1 m to 0.5 m/coil, and a width between 6 m and 20 m.

13. The apparatus of claim 1 wherein the process coils are arranged across the width with the two U-tubes arrayed substantially along an axis that is in the middle of the width of the shell and wherein the burners are disposed on opposite sides that are the ends defining the depth of the shell.

14. An apparatus for heating a process fluid, comprising:

a shell having sides, an upper surface, a lower surface, combustion fluid inlets and a flue gas outlet, and wherein the shell has a substantially rectangular prismatic shape, with a height, a depth and a width;

a plurality of process coils, each process coil comprising two inlet ports, a first inlet port and a second inlet port, two U-shaped process tubes with the end of each tube merging to form one outlet port, and disposed within the shell; and at least two burners disposed on the sides of the shell, and in an opposing configuration;

wherein, the plurality of process coils have the inlet ports and outlet port on the upper surface, and the flue gas outlet is centered on the lower surface.

15. The apparatus of claim 14 further comprising:

a first manifold having an inlet and multiple outlets, wherein each outlet is in fluid communication with the first inlet port of the process coil;

a second manifold having an inlet and multiple outlets, wherein each outlet is in fluid communication with the second inlet port of the process coil; and a third manifold having multiple inlets and an outlet, wherein each inlet is in fluid communication with the outlet of the process coil.

16. The apparatus of claim 14 wherein the burners are disposed on opposite sides of the width of the shell, and wherein the burners are disposed less than 10% of the height from the bottom of the shell.

17. The apparatus of claim 16 wherein the apparatus further includes at least a second pair of burners disposed on opposite sides of the width of the shell and at a height between 30% and 80% of the height from the bottom of the shell.

18. The apparatus of claim 14 wherein the process coil has a configuration of four tubes in a parallel orientation, with two semi-circular tubular sections connecting the ends of pairs of the tubes, such that the tubes form a coil having two U-shaped sections, with each U-shaped section having an outer tube closer to the sides of the shell and an inner tube closer to the centerline of the shell, and wherein each U-shapes has the inner tube diameter smaller than the outer tube diameter.

19. The apparatus of claim 14 wherein the U-shaped sections are oriented such that the outlet section is toward the mid-point between the shell sides, and the inlet sections are between the outlet sections and the shell sides.

20. The apparatus of claim 19 wherein the inner tubes are staggered from each other and communicating to outlet manifold disposed outside the shell, wherein the spacing between two adjacent inner tubes of the U-tube coils originated from same inlet manifold is between 38 mm to 150 mm.

21. The apparatus of claim 20 wherein the inner tubes of the process coils communicate with a third manifold substantially in parallel direction to the radial direction of the third manifold above the shell.

22. An apparatus for heating a process fluid, comprising:

a shell having sides, an upper surface, a lower surface, combustion fluid inlets and a flue gas outlet;

at least one process coil comprising two U-shaped sections, with each U-shaped section having a first end as an inlet port and a second end as an outlet port, the process coil has a configuration of four tubes in a parallel orientation, with two semi-circular tubular sections connecting the ends of pairs of the tubes, such that the tubes form a coil having two U-shaped sections, with each U-shaped section having an outer tube closer to the sides of the shell and an inner tube closer to the centerline of the shell, and wherein each U-shapes has the inner tube diameter smaller than the outer tube diameter; and at least two burners disposed on the lower surface of the shell, and in an opposing configuration toward the sides of the shell.

* * * * *